US005333417A

United States Patent [19]

Demartini

[11] Patent Number: 5,333,417

[45] Date of Patent: Aug. 2, 1994

[54] LAMINAR FLOW GENERATION DEVICES

[75] Inventor: Robert J. Demartini, Flat Rock, N.C.

[73] Assignee: Drainage Products, Inc., John's Island, S.C.

[21] Appl. No.: 61,022

[22] Filed: May 14, 1993

[51] Int. Cl.[5] ..... E04D 13/00

[52] U.S. Cl. ..... 52/11; 52/12; 52/13

[58] Field of Search ..... 52/11, 12, 13, 14, 15, 52/16; 239/24, 193, 504

[56] References Cited

U.S. PATENT DOCUMENTS

| | | | |
|---|---|---|---|
| 233,677 | 10/1880 | Hess | 52/11 X |
| 1,986,383 | 1/1935 | Usinger | 52/13 X |
| 2,899,916 | 8/1959 | Ertman | 52/13 |
| 3,133,377 | 5/1964 | Jackson | 52/11 X |

*Primary Examiner*—Carl D. Friedman
*Assistant Examiner*—Kevin D. Wilkens
*Attorney, Agent, or Firm*—William G. Rhines

[57] ABSTRACT

This invention comprises laminar flow generation devices that are adapted to be affixed to the upper, substantially flat surfaces of a rain gutter deflector system. They have at least one water diverting surface which rises abruptly from such upper surface and provides for the smooth redirection of water from the region of its top end through an angular displacement preferably not in excess of 90 degrees to the other of its ends from which the water is discharged. Embodiments may have two such water diverting surfaces with a common leading edge to divide the water and redirect the resulting flows away from each other. They may be further adapted for affixation to gutter deflector surfaces which intersect each other at an angle, as at the site of a roof valley. The diverting surfaces may include apertures to provide flow paths for water to further reduce the volume of the water discharged at the egress end of the diverting surfaces.

20 Claims, 2 Drawing Sheets

LAMINAR FLOW GENERATION DEVICES

BACKGROUND OF INVENTION

In my U.S. Pat. No. 4,404,775, which issued on Sep. 20, 1983, I disclosed a new and useful rain water deflector device by means of which rain water falling from a roof on a building may be made to be deposited into a rain gutter affixed to the building, while leaves, pine needles and other debris carried by the water are caused to fall to the ground by being jettisoned outward past the outer edge of the gutter. By this means, the gutter may be kept substantially free of accumulations of debris, obviating the necessity of cleaning the gutters in order to keep them functioning as desired. According to the teachings of that patent, these deflector devices function by providing means by which the gravitation induced kinetic forces present in the masses of water are kept within the ability of the surface tension of the water to cause the water to follow the curved lower surface of the deflector devices along a path of travel into the gutter. Several examples are presented of embodiments which implement those principles. Included among the means by which they do so are longitudinal ribs formed in the flat top surface of the deflector devices to form weir-like water flow interrupters which reduce the kinetic force of the water, bracket supports which cause the deflectors to present a shallower slope to the oncoming water than does the associated roof, and wettable deflector surfaces which cause the water to "sheet" or spread into laminar, rather than rivuletted, flow patterns and reduce the kinetic force per unit area by increasing the area over which a given unit of kinetic force is spread.

It has been found that some roof configurations with which embodiments of that invention are used present special difficulties for which specialized approaches are advantageous. For example, a roof "valley", (i.e., the intersection between intersecting, sloping roof sections), effectively concentrates into a single flow path water that has come down to it from higher portions of each of its constituent sections. Since the valleys typically are sloped, water from the larger areas at the top of the roof sections concentrates in increasing amounts in the stream path created by the valley itself as it goes down the valley. The resulting concentration of the mass of water is counter to the teachings of my U.S. Pat. No. 4,404,775 where embodiments are disclosed which serve to de-concentrate accumulations of water from rivulets into laminar or sheet-like configurations. Thus, water has been found to overflow deflector devices according to that patent when they are positioned at the foot of such valleys. In some cases, the concentrations of water, and therefore the kinetic forces which gravity produces in them, are so great that even a barrier plate across the valley substantially at right angles to the water flow path may prove ineffectual. The water colliding with such a barrier may become so turbulent that some may overflow the barrier, and even though some of the water may be redirected to the ends of the barrier, some of that may discharge from the ends of the barrier in concentrations so massive that water still overshoots the curved surface of the associated deflectors. Additionally, such barrier type devices themselves tend to act as traps for some of the debris being transported by the water, further disrupting any laminar flow or sheeting generation that might otherwise occur.

Accordingly, it is an object of this invention to provide means to enhance the operation of rain gutter deflector devices.

Another object of this invention is to provide means to satisfy the foregoing objective by causing improved laminar flow of concentrations of rain water.

Still another object of this invention is to provide means to satisfy the foregoing objectives that is adapted for retrofitting to existing installations.

Yet another object of this invention is to provide means to satisfy the foregoing objectives that also reduces the amount of debris accumulating on the face of the associated deflector to the detriment of desired water flow patterns.

Another object of this invention is to provide means to satisfy the foregoing objectives that minimizes the effect that the presence of debris has on the desired patterns of water flow across the system.

STATEMENT OF INVENTION

Desired objectives may be achieved through practice of the present invention, embodiments of which comprise laminar flow generation devices that are adapted to be affixed to the upper, substantially flat surfaces of a rain gutter deflector system, each of which devices has at least one water diverting surface which, when the device is so affixed, rises abruptly from said upper surfaces and provides a surface for the smooth redirection of the flow path of concentrations of water encountering it in the region of one of its ends through an angular displacement preferably not in excess of 90 degrees to the other of its ends from which the water is discharged. Some embodiments may have two such water diverting surfaces with a common leading edge, and are adapted to divide a concentration of water flowing across such surfaces and to redirect the resulting divided flows away from each other. The latter devices may be further adapted for affixation to gutter deflector surfaces which intersect each other at an angle, as at the site of a roof valley. In preferred embodiments, the angular displacement capability of each water diverting surface is less than 90 degrees. The diverting surfaces of any of the embodiments of this invention may include apertures to provide flow paths through which water may flow so as to further reduce the volume of the water discharged at the egress end of said surfaces.

DESCRIPTION OF DRAWINGS

This invention may be understood from the description which follows and from the accompanying drawings in which.

DESCRIPTION OF PREFERRED EMBODIMENTS

Figure 1:
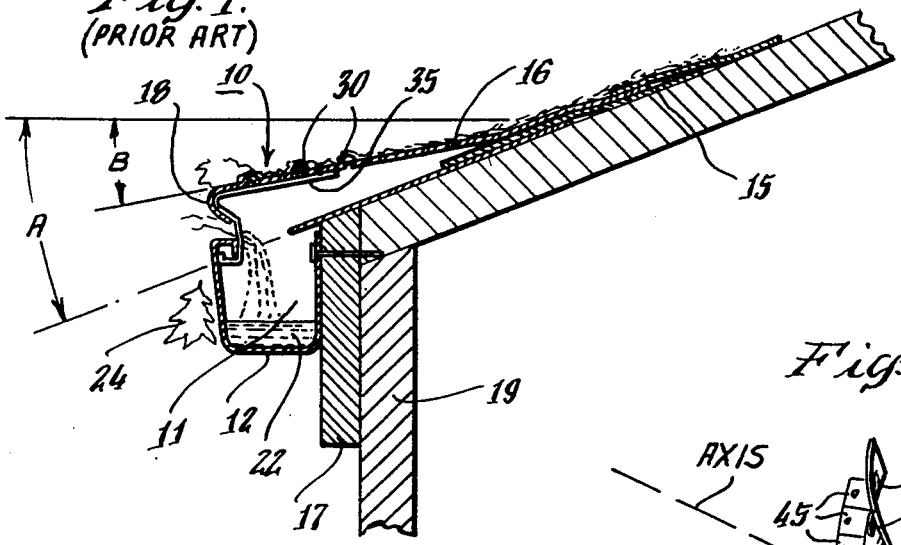
Fig. 1. (PRIOR ART)
FIG. 1 is a cross-sectional view of an embodiment of a prior art device according to U.S. Pat. No. 4404775.

Referring first to FIG. 1, there is shown a prior art device comprising a deflector 10 in accordance with the teachings of my U.S. Pat. No. 4,404,775. The deflector is positioned above the trough 11 of a rain gutter 12 that is affixed to the fascia board 17 at the top of a building wall 19. The outermost end of the deflector 10 that is beneath the curved part 18 of the deflector is affixed to the gutter 12 by means of hangers 35, while the upper, flat portion of the deflector 16 of the deflector is positioned atop the roof section 15. This embodiment incorporates three structural features directed to attenuating the kinetic energy of rainwater falling from the roof so as to keep it within the ability of the surface tension of the water to cause the water to follow the curved portion 18 of the deflector 10 into the gutter 12. They are the longitudinal ridges 30, the relatively shallower angle "B" of the deflector 10 as compared to the slope "A" of the roof shingles 15, and the relative high wetability of the upper surface of the deflector 10. While all three of these contribute to lowering the kinetic energy per unit area ratio of the water, albeit by approaches which are different from each other, other means for achieving that same effects, alone or in combination as among them, may also be utilized. While the water is thereby directed into the gutter, leaves and other debris 24 carried along by the water are jettisoned over the front edge of the gutter, while that which sticks to the deflector surfaces will tend to be retained by them and, upon subsequent drying, usually are blown off by the wind. The net result is that substantially all of the debris is kept out of the rain gutter.

In some situations, such as at the "valley" of a roof where two roof surfaces come together, or where water is discharged from one roof surface to another as from a dormer roof to a main roof, water may become concentrated in sufficient mass for its gravitationally induced kinetic energy to exceed the ability of a gutter deflector to redirect it through the operation of the surface tension of the water. Thus, in such situations, some of the previously operative features of such deflector devices may be compromised or rendered inoperative to such an extent that the operation of the deflector device is significantly adversely affected. Of course, it may still be possible to utilize weir producing ridges 30, and/or to set the deflectors at shallower angles than those of the intersecting roof surfaces on which they rest. However, the concentration of a mass of water into a comparatively narrow stream may be too great for attenuation of its kinetic energy by these means to enable its surface tension not to be exceeded and the deflector to guide it into the gutter. Instead, the water may simply disassociate itself from the curved surface of the deflector and jettison over the edge of the gutter in the region immediately at the base of the stream. That is particularly the case where increased volumes of water are gathered from the greater areas of roof adjacent the upper regions of a valley or where the stream is being fed by more than one roof surface.

Figure 2:
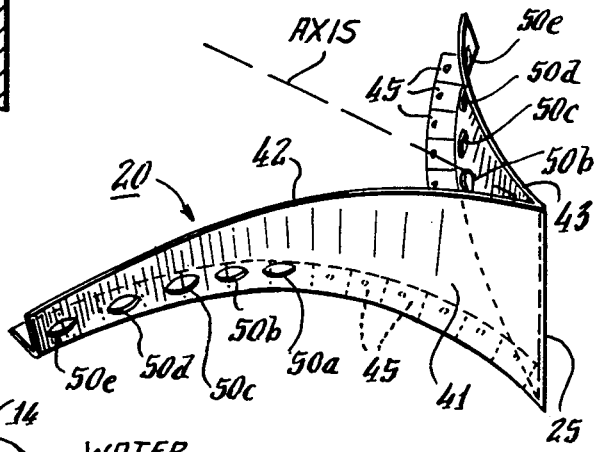
FIG. 2 is a perspective view of an embodiment of this invention.
Figure 3:
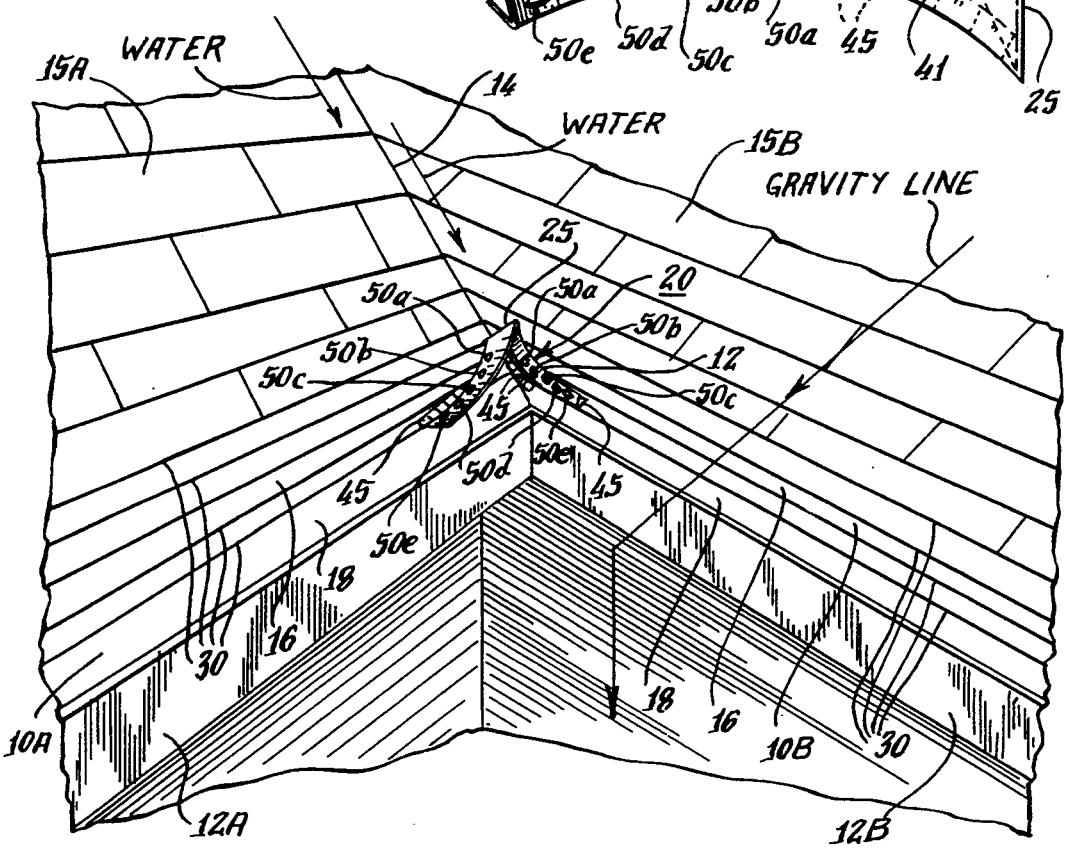
FIG. 3 is a perspective view of an embodiment of this invention in use.

Such a situation, in this case in the form of a roof valley, and a laminar flow generator according to the present invention for dealing with it as shown in greater detail in FIG. 2, is illustrated in FIG. 3. Comparably to the arrangement shown in FIG. 1, deflectors 10A, 10B are retentively positioned above rain gutters 12A, 12B on the top of building roof sections 15A, 15B, with the topmost edge of the deflectors 10A, 10B optionally underlying courses of shingles to facilitate the transfer of water from the roof to the deflector. Each of the embodiments of this invention herein illustrated also may include tabs 45 formed as an integral part of their structure, or other appropriate means for anchoring the devices to the underlying deflector and/or roof surfaces, as by nailing or other known means. Each of the deflectors 10 has an upper flat portion 16, a curved portion 18, and upper surface "weirs" or ridges 30. The roof sections 15A, 15B abut at an angle along a valley 14 to which water falls by gravity from the sections of roof that are above it. The direction which water freely falling down the surface of the roof will follow when influenced solely by the force of gravity defines the orientation of the "water flow path" that is also shown in FIGS. 3 and 4.

Figure 4:
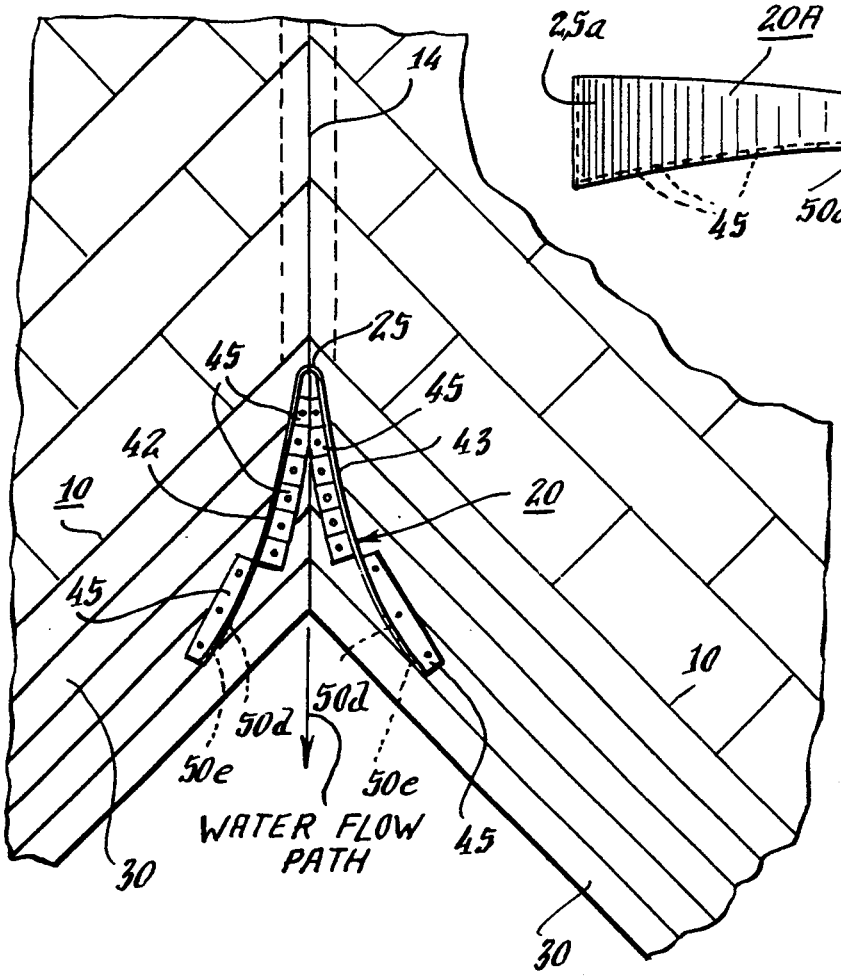
FIG. 4 is a plan view in use of the embodiment of this invention shown in FIG. 3.

A laminar flow generator 20 which embodies this invention is shown in FIGS. 2, 3 and 4. It includes a body member which has a leading edge 25. Functions of such leading edges include to interdict an oncoming stream and/or to divide such a stream so as to reduce it into smaller streams which flow in different directions from each other and (preferably) are substantially balanced as to the amount of water constituting each. Another benefit accrues, however, in that any debris which may build up on such a leading edge enhances the deflection laterally of the water streams and the resulting "sheeting" action rather than blocking the flow and further concentrating water as may happen with a simple cross-stream barrier. This particular embodiment has a pair of trailing edges 42, 43 which curve outward away from each other along lines of progressively decreasing radii. Embodiments, such as those shown in FIGS. 5 and 6 include only a single trailing edge **42*a* which, with respect to the leading edge 25*a*, curves in the same general direction as does the trailing edge 42 shown in FIGS. 2, 3 and 4. Of course, another embodiment similar to that shown in FIGS. 5 and 6 might also have a single trailing edge, but curving in the opposite direction; i.e., in the direction corresponding to that shown for trailing edge 43 in FIGS. 2, 3 and 4**. In addition, it should be noted that any of the water deflector surfaces also or alternatively may be regularly arcuate, or in the form of a series of connected straight and/or curved segments or of a leg of a parabola, or may be of any of a wide variety of geometric shapes. Desirably, they provide redirection of the water in a manner which is comparatively smooth (i.e., does not induce untoward turbulence) from its original flow path through an angular disposition sufficient to cause the water coming from the egress end of the deflecting surface to be projected across the flat surface of the deflector member and to "sheet" or assume a laminar flow. In most instances, the device will be so oriented that the angle at which the flow of water impinges upon its redirection surfaces in the region of its leading edge will desirably be very small (it might even be 0 degrees). Therefore, the total angular displacement of the redirection surface usually will be not more than 90 degrees. By that means, the high horizontal force component on the water egressing the device at the egress end of the redirection surface will enhance the creation of laminar flow or "sheeting" in the water as it spreads across the flat portion of the deflector members before beginning to move downward in response to the effect of gravity forces. However, it is within the contemplation of this invention that that angular displacement may exceed 90 degrees, for example, to enhance the discharge of water through apertures in the diverting wall. The exact configuration of the embodiment chosen will be determined by a variety of factors, of importance among which is the situs of the device and the velocity and mass of water involved in the problem it is being used to solve.

The trailing edges of the embodiments illustrated include apertures 50*a* . . . 50*e*. Although five such apertures are shown, it will be apparent that any number may be utilized. The apertures are of sufficient area to pass as much water as possible without it exceeding the ability of the curved surface of the deflector below to cause the resulting stream to be redirected into the gutter. Thus, before the water reaches the other end of those surfaces, the apertures release tolerable amounts of water from that which is being diverted by the redirecting surfaces, but avoid creating such concentrations of water in downward orientations of flow as are likely to cause the water to overshoot the curved surfaces of the deflector members. At the same time, the volume of water flowing over the redirection surface of the laminar flow generator is sufficient to keep it substantially clear of debris accumulations. For example, it has been found that these objectives are achieved for the rainfall and debris conditions which obtain in the mid-South region of the United States utilizing redirecting surfaces having an array of five apertures that are ⅝" long by 5/16" high, spaced ¼" apart and close to the deflector flat surface. The leading edge of the redirection surfaces may be taller than the other (trailing) edge since decreasing amounts of water are being redirected progressively by the device along its length. Similarly, the leading edge may present a substantially vertical surface to oncoming water, but this is not essential and it might be an angled plow shape in the alternative.

Figure 5:
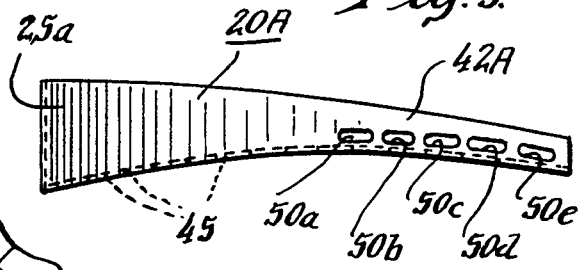
FIG. 5 is a side elevation view of another embodiment of this invention.
Figure 6:
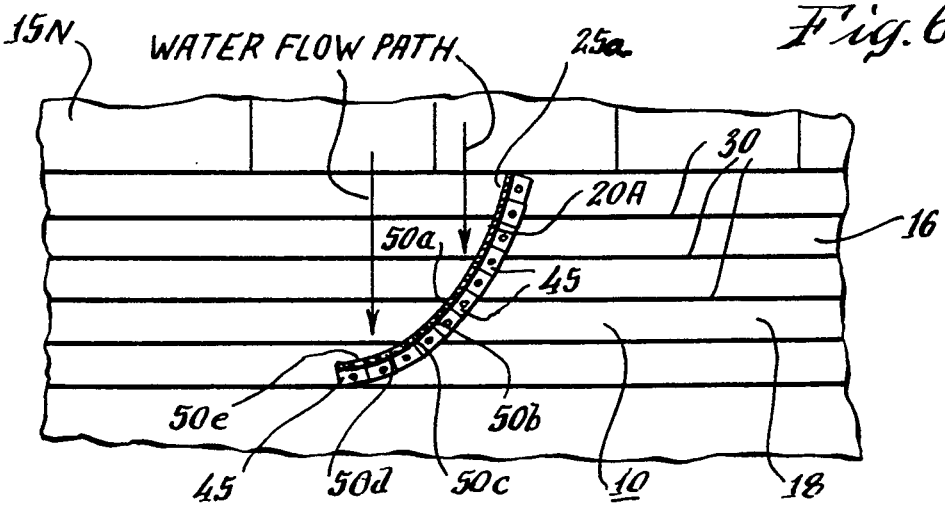
FIG. 6 is a plan view in use of the embodiment of this invention shown in FIG. 5.

It will be seen then that the basic configuration of these various embodiments is substantially comparable insofar as their operation is concerned. Those according to FIGS. 2, 3 and 4 present two trailing edges having a common leading edge, and therefore are particularly adapted for use in situations, such as at the bottom of a roof valley, where a concentrated stream of water is to be redirected and/or reduced in size and sent in more than one direction before causing it to sheet. Such capability is advantageous particularly when applied to surfaces which are not in the same flat plane with respect to each other, as is the usual case with a roof valley where adjoining roof surfaces intersect at an angle to each other. In contrast, the single trailing edge embodiments shown in FIGS. 5 and 6 are particularly adapted for use in situations such as to redirect a concentrated stream of water coming to a roof surface from other roof surfaces, as is the case with water falling from a dormer roof to a lower roof and cascading along the side of the dormer. This situation is to be distinguished from that of an ordinary straight or chevron-shaped deflectors of the type sometimes used, for example, to lessen the flow of rainwater at the roof edge over a door. In those cases, there is no need to cause the water to become laminar or sheeted so that it will be not overshoot the associated deflector surface; a result produced in the present invention by introducing a strong lateral component to the water by having the diverter curved, rather than straight.

These are the two situations illustrated in FIGS. 4 and 6 respectively. In use, these two embodiments may advantageously be positioned somewhat differently from each other vis-a-vis the stream of water. As is shown in FIGS. 3 and 4, when the embodiment having two trailing edges is used at the base of a roof valley, the common leading edge 25 may be positioned so as to interdict the onrushing flow of water more or less at the middle, thus apportioning the water substantially evenly as between the deflector surfaces 12A and 12B. In contrast, in situations such as that illustrated in FIG. 6, the objective may be to interdict an oncoming stream but to redirect it along only one portion of a deflector surface. In that situation, the leading edge 25*a* of the laminar flow generator may advantageously be positioned so that the generator intercepts the stream of water along its curved upper surface, preferably short of the leading edge, at an intercept angle of 0 degrees or slightly greater.

The operation of devices which embody this invention may be seen particularly from FIGS. 3, 4 and 6. In FIGS. 3 and 4, water will fall along the top surfaces of the roof panels 15A and 15B generally in the direction of the valley until it comes to the roof valley 14. There it shifts direction and falls along the roof valley until it is intercepted by the common leading edge 25 of the laminar flow generator 20, whose redirection surfaces 42, 43, are progressively more distant from each other and from the flow path the water would have had but for having been interdicted.

The oncoming water is thereby redirected from a concentrated rivulet coming down the valley into a laminar sheet of water that is spread across the top surfaces of the deflectors. Gravity then operates to redirect the water toward flowing in the direction of the normal flow line while still in the laminar, sheet-like state, thus allowing the curved surfaces 18 of the deflector surfaces thereafter to divert the water into their associated gutters 12A, 12B. A similar result occurs when other embodiments of this invention, such as the single trailing edge embodiments shown in FIGS. 5 and 6, are utilized. At the same time, water is passing through the holes 50*a* . . . 50*e*, in large enough volume to reduce the amount of water passing the trailing edge of the device. This enhances the ability of the device to "sheet" the water sufficiently for it to be accommodated by the curved surfaces of the underlying diverter system, but with the water passing through the holes 50*a* . . . 50*e* still being in small enough volume that it does not overflow the curved portions of the deflectors immediately beneath the holes.

It should be noted that the angular disposition between the unimpeded water flow path and of the water redirecting surfaces near their leading edges is not critical so long as it is sufficiently shallow to avoid substantially the water overflowing those surfaces. Similarly, the comparable angular disposition of those surfaces at their trailing edges should be sufficiently great to ensure that the horizontal force component of water egressing the device causes the water to spread laterally across the top surfaces of its associated deflectors and thereby form a laminar sheet that is susceptible to being deflected into the associated gutters by the curved surfaces of the deflectors. Resolution of these details, given the desired affects, will be within the competence of those with skills in the cognizant arts.

Accordingly, it is to be understood that the embodiments of this invention herein discussed and depicted are by way of illustration and not of limitation, and that a wide variety of embodiments may be made without departing from the spirit or scope of this invention.

I claim:

1. A laminar flow generation device that is adapted to be affixed to the upper surfaces of a rain gutter water deflector system in the flow path of water traversing said surfaces, comprising at least one elongated laminar flow generation surface which, when said device is affixed to the upper surfaces of a rain gutter water deflector system in the flow path of water traversing said surfaces, is impinged upon by said water in the region of one of its ends and thereafter smoothly redirects at least a portion of the gravitationally impelled flow of the water which has impinged upon it along its length at progressively increasingly greater angles from said flow path to a maximum not in excess of about 90 degrees.

2. The device described in claim 1 having two such laminar flow generation surfaces with a common leading edge upon which said water impinges, each of which surfaces diverges from the other to redirect the water flowing along its length in a direction which is away from the other of said surfaces.

3. The device described in claim 1 wherein said laminar flow generation surface is of a regular arcuate geometric shape.

4. The device described in claim 2 wherein said laminar flow generation surfaces are of a regular arcuate geometric shape.

5. The device described in claim 1 wherein said flow generation surface includes at least one weep hole extending through said surface, each of which weep holes provides a flow path through which a predetermined maximum amount of water may flow.

6. The device described in claim 2 wherein said flow generation surface includes at least one weep hole extending through said surface, each of which weep holes provides a flow path through which a predetermined maximum amount of water may flow.

7. The device described in claim 3 wherein said flow generation surface includes at least one weep hole extending through said surface, each of which weep holes provides a flow path through which a predetermined maximum amount of water may flow.

8. The device described in claim 4 wherein said flow generation surface includes at least one weep hole extending through said surface, each of which weep holes provides a flow path through which a predetermined maximum amount of water may flow.

9. A laminar flow generation device comprising two elongated water redirection surfaces, each of which is joined at one of its ends to an end of the other to form a common leading edge, and the opposite ends of which are spaced apart from each other, said surfaces being substantially symmetrical with respect to a median line between them and being at progressively increasing angles with respect to said median line at corresponding successive points along said median line moving away from said common leading edge, affixation means for affixing said device to the upper surfaces of associated rain deflectors devices with said median line aligned substantially to the flow path of water traversing said deflector devices and in the flow path of such water, said redirection surfaces being angularly disposed with respect to said upper surfaces when said device is so affixed to the upper surfaces of associated rain deflectors.

10. The device described in claim 9 wherein said redirection surfaces are regularly arcuate geometrically.

11. The device described in claim 9 wherein said redirection surfaces are angularly disposed with respect to said upper surfaces when said device is affixed to said upper surfaces by means of said affixation means at substantially a right angle.

12. The device described in claim 10 wherein said redirection surfaces are angularly disposed with respect to said upper surfaces when said device is affixed to said upper surfaces by means of said affixation means at substantially a right angle.

13. The device described in claim 9 wherein each of said flow generation surfaces includes at least one weep hole extending through said surface, each of which weep holes provides a flow path through which a predetermined maximum amount of water may flow.

14. The device described in claim 10 wherein each of said flow generation surfaces includes at least one weep hole extending through said surface, each of which weep holes provides a flow path through which a predetermined maximum amount of water may flow.

15. The device described in claim 11 wherein each of said flow generation surfaces includes at least one weep hole extending through said surface, each of which weep holes provides a flow path through which is predetermined maximum amount of water may flow.

16. The device described in claim 12 wherein each of said flow generation surfaces includes at least one weep hole extending through said surface, each of which weep holes provides a flow path through which a predetermined maximum amount of water may flow.

17. A laminar flow generation device comprising an elongated water redirection surface, one end of which forms a leading edge, affixation means for affixing said device to the upper surfaces of associated rain deflector devices in a desired orientation with respect to the normal flow path of water traversing said deflector devices, with said leading edge in said normal flow path and with the opposite end spaced apart from said normal flow path at progressively increasing angles at successive points along and with respect to said normal flow path moving away from said leading edge, said redirection surface being angularly disposed with respect to said upper surface with said device is affixed to the upper surfaces of associated rain deflectors 18. The device described in claim 17 wherein said redirection surface is regularly arcuate geometrically.

19. The device described in claim 17 wherein said flow generation surface includes at least one weep hole extending through said surface, each of which weep holes provides a flow path through which a predetermined maximum amount of water may flow.

20. The device described in claim 18 wherein said flow generation surface includes a plurality of "weep" holes extending through said surface, each of which weep holes provides a flow path through which a predetermined maximum amount of water may flow.

* * * * *